United States Patent [19]

Leighton

[11] 4,093,894

[45] June 6, 1978

[54] STAY-ON LAMP

[75] Inventor: Leroy G. Leighton, Highland Heights, Ohio

[73] Assignee: General Electric Company, Schenectady, N.Y.

[21] Appl. No.: 741,898

[22] Filed: Nov. 15, 1976

[51] Int. Cl.[2] ..... H01J 7/44; H01J 13/46; H01J 17/34; H01K 1/62

[52] U.S. Cl. ..... 315/64; 315/66; 315/67; 315/69; 315/73; 315/74

[58] Field of Search ..... 315/73, 74, 75, 104, 315/66, 67, 69, 64, 65; 313/151

[56] References Cited

U.S. PATENT DOCUMENTS

| | | | |
|---|---|---|---|
| 3,227,920 | 1/1966 | Peek, Jr. et al. | 313/151 X |
| 3,382,403 | 5/1968 | Lloyd | 315/73 X |
| 3,638,068 | 1/1972 | Wilson | 315/67 |

*Primary Examiner*—Saxfield Chatmon, Jr.
*Attorney, Agent, or Firm*—Paul F. Wille; Lawrence R. Kempton; Frank L. Neuhauser

[57] ABSTRACT

A lamp is described having an internal switch for keeping at least one filament incandescent for a predetermined time after an external switch indicates the user wishes to turn the lamp off.

6 Claims, 3 Drawing Figures

STAY-ON LAMP

BACKGROUND OF THE INVENTION

This invention relates to incandescent lamps and, in particular, to an incandescent lamp having an internal switch for keeping at least one filament of the lamp in an on condition after the main circuit to the lamp is opened.

In the prior art, a number of lighting systems have been proposed for buildings and automobiles in which a lamp is temporarily kept lighted until the user has left the premises or otherwise no longer needs the light. The difficulty with prior art solutions to the problem is that additional wiring or circuitry is necessary, which may not be aesthetically pleasing, practical, or the least costly solution.

SUMMARY OF THE INVENTION

In view of the foregoing, it is therefore an object of the present invention to provide a lamp having temporary stay-on characteristics.

Another object of the present invention is to provide a stay-on lamp compatible with existing household wiring.

The foregoing objects are achieved in the present invention wherein a lamp is provided with a bimetallic element for closing a secondary circuit after a primary circuit is closed, energizing the filament. After the primary circuit is opened, the secondary circuit remains closed for a predetermined length of time and then opens.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
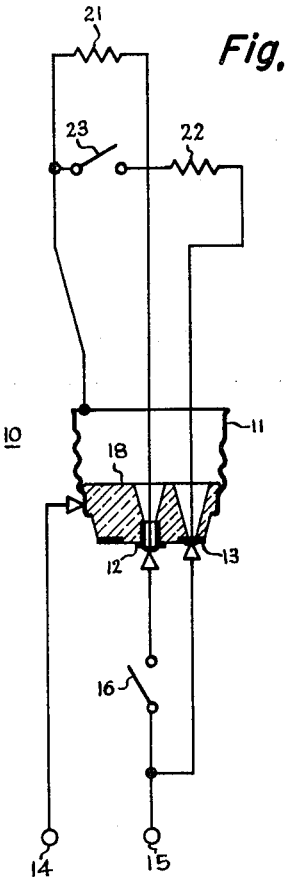
FIG. 1 is a partial schematic of a lamp in accordance with the present invention.

FIG. 1 illustrates one embodiment of the present invention wherein high and low luminosity filaments are combined in a single lamp and connected to a suitable source of power by a base having three contacts. Specifically, base 10 comprises a shell 11 having a central contact 12 and a contact ring 13 encircling central contact 12. Contacts 12 and 13 are insulated from each other and from shell 11 by a suitable insulator 18. Shell 11 is connected to one terminal of the power source, such as the ground connection, represented by terminal 14. Central contact 12 is connected by way of switch 16 to the other terminal 15 of the power source. Contact ring 13 is connected directly to terminal 15.

Inside the lamp, a primary or high luminosity filament 21 is connected between shell 11 and central contact 12. A secondary or lower luminosity filament 22 is connected between shell 11 and contact ring 13. However, the circuit including secondary filament 22 includes switch 23 which operates in response to thermal radiation from primary filament 21. Switch 23, which preferably comprises a bimetallic element, is normally open and closes shortly after primary filament 21 is energized. When primary filament 21 is turned off, switch 23 cools and, after a predetermined length of time, reopens the circuit including secondary filament 22. The visual effect is that when the lamp is turned off, a lower brightness or night-light effect is obtained for a predetermined duration, e.g., 30–60 seconds, after which the lamp goes completely dark.

The embodiment of FIG. 1, while using connections to a standard three-way base, will not produce the stay-on characteristic when connected to a standard three-way socket, which are usually wired for a low-medium-high switching sequence.

Figure 2:
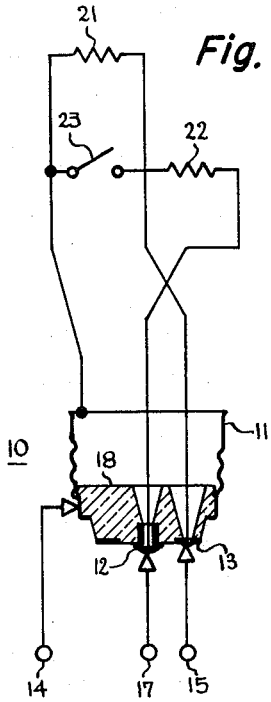
FIG. 2 is a partial schematic of a preferred embodiment of the present invention.

In the embodiment of FIG. 2, the connections between the central contact and the contact ring are reversed to provide the stay-on effect when utilized with a standard three-way socket. In FIG. 2, where like elements with FIG. 1 bear the same reference numeral, central contact 12 and contact ring 13 are connected respectively to the central and ring contacts 17 and 15 respectively of a standard three-way socket. Internally, primary filament 21 is connected to contact ring 13, while secondary filament 22 is connected to central contact 12.

With this change in the internal connections of the lamp, a low-medium-high sequence three-way socket will energize filament 21 first, filament 22 second (if switch 23 is closed), and both filaments together in the high position. In use, the lamp is turned on to the first position which energizes filament 21 and closes, after a short delay, switch 23. Switching the lamp to the second (medium) position turns off filament 21 and energizes filament 22 by way of switch 23. After a predetermined length of time, switch 23 opens turning off filament 22. Thus, by utilizing a standard three-way socket, the stay-on characteristic is obtained without changes in household wiring.

Figure 3:
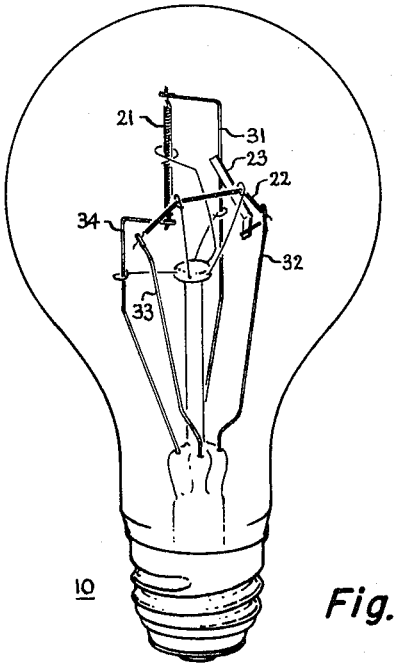
FIG. 3 illustrates the construction of a lamp in accordance with the present invention.

FIG. 3 illustrates a perspective view of a stay-on lamp in accordance with the present invention. Specifically, filament 21, which may comprise a 100 to 200 watt filament, is connected between leads 31 and 34 while secondary filament 22, which may comprise a 15 to 25 watt filament, is connected between leads 32 and 33. Switch 23 is illustrated as a bimetallic strip positioned adjacent lead 31 and connected, for example by welding, to lead 32. Bimetallic strip 23 may comprise any suitable material such as "Chace No. 2500 Thermostatic Bimetal" as available from W. M. Chace Company, or "Truflex E5" as available from Metals Controls Corporation.

Except for the short segment connecting filament 22 with bimetallic strip 23, lead wire 32 provides only a supportive function and is not electrically connected to any of the contacts in base 10. Lead 31 in FIG. 3 corresponds to the connection in FIG. 2 from filament 21 to contact 13. Leads 33 and 34 in FIG. 3 are connected together to base 10 and correspond to the line in FIG. 2 connecting filament 21 and switch 23 to shell 11.

There is thus provided by the present invention a lamp having temporary stay-on characteristics compatible with existing household wiring. Having described a preferred embodiment of the present invention, it will be apparent to those of skill in the art that various modifications can be made within the spirit and scope of the present invention. For example, while standard lamp components can be utilized, it may be desirable to construct leads 31 and 32 of slightly heavier wire, for example, 18- or 20-mil wire instead of 14- or 16-mil wire, to provide additional stiffness for the switch. Also, while illustrated as a household incandescent lamp utilizing a medium screw three-way base, any suitable configuration to meet the specific application can be used, for example, single-ended or double-ended lamps utilized for automotive applications.

What I claim as new and desire to secure by Letters Patent of the United States is:

1. A stay-on incandescent lamp comprising:
a primary filament;
a secondary filament which is less luminous than said primary filament;
switch means within said lamp for closing a circuit including said secondary filament in response to thermal radiation from said primary filament and maintaining said closed circuit for a predetermined time after thermal radiation from said primary filament ceases; and wherein
said lamp comprises three terminals, one of which is connected to both said primary filament and said circuit, a second of which is connected to the other end of said primary filament, and a third of which is connected to the other end of said circuit.

2. The lamp as set forth in claim 1 wherein said lamp comprises a base having a shell, a center contact and a contact ring encircling said center contact.

3. The lamp as set forth in claim 2 wherein said shell is said first terminal and said center contact is said second terminal.

4. The lamp as set forth in claim 3 wherein said switch means comprises a bimetallic element.

5. The lamp as set forth in claim 2 wherein said shell is said first terminal and said contact ring is said second terminal.

6. The lamp as set forth in claim 5 wherein said switch means comprises a bimetallic element.

* * * * *